US009504135B2

(12) United States Patent
Caiafa et al.

(10) Patent No.: US 9,504,135 B2
(45) Date of Patent: Nov. 22, 2016

(54) APPARATUS AND METHOD FOR MAGNETIC CONTROL OF AN ELECTRON BEAM

(75) Inventors: Antonio Caiafa, Niskayuna, NY (US); Maja Harfman Todorovic, Niskayuna, NY (US); Joseph Leclaire Reynolds, Amsterdam, NY (US)

(73) Assignee: General Electric Company, Niskayuna, NY (US)

( * ) Notice: Subject to any disclaimer, the term of this patent is extended or adjusted under 35 U.S.C. 154(b) by 482 days.

(21) Appl. No.: 12/845,579

(22) Filed: Jul. 28, 2010

(65) Prior Publication Data

US 2012/0027165 A1 Feb. 2, 2012

(51) Int. Cl.

| | |
|---|---|
| ***H05G 1/08*** | (2006.01) |
| ***H05G 1/52*** | (2006.01) |
| ***H01J 35/14*** | (2006.01) |
| ***H01J 35/30*** | (2006.01) |
| ***H01J 29/76*** | (2006.01) |

(52) U.S. Cl.

CPC ..... *H05G 1/52* (2013.01)

(58) Field of Classification Search

USPC ..... 378/16, 91, 137, 138; 315/364, 399, 315/408

See application file for complete search history.

(56) References Cited

U.S. PATENT DOCUMENTS

| | | | | | |
|---|---|---|---|---|---|
| 4,206,388 | A | * | 6/1980 | Ishigaki et al. | 315/371 |
| 4,242,714 | A | * | 12/1980 | Yoshida et al. | 361/152 |
| 5,550,442 | A | * | 8/1996 | Ueyama et al. | 315/371 |
| 5,550,889 | A | | 8/1996 | Gard et al. | |
| 5,812,632 | A | * | 9/1998 | Schardt et al. | 378/137 |
| 5,822,395 | A | * | 10/1998 | Schardt et al. | 378/137 |
| 5,898,755 | A | * | 4/1999 | Meusel et al. | 378/137 |
| 6,055,294 | A | * | 4/2000 | Foerst et al. | 378/138 |
| 6,091,799 | A | * | 7/2000 | Schmidt | 378/137 |
| 6,111,934 | A | * | 8/2000 | Foerst et al. | 378/137 |
| 6,128,367 | A | | 10/2000 | Foerst et al. | |
| 6,252,935 | B1 | * | 6/2001 | Styrnol et al. | 378/137 |
| 6,292,538 | B1 | | 9/2001 | Hell et al. | |
| 6,339,635 | B1 | * | 1/2002 | Schardt et al. | 378/137 |
| 7,082,188 | B2 | * | 7/2006 | Deuringer | 378/113 |
| 7,327,092 | B2 | | 2/2008 | Caiafa et al. | |
| 7,439,682 | B2 | | 10/2008 | Caiafa et al. | |
| 7,639,785 | B2 | | 12/2009 | Kirshner et al. | |
| 7,839,979 | B2 | * | 11/2010 | Hauttmann et al. | 378/137 |

FOREIGN PATENT DOCUMENTS

| | | | |
|---|---|---|---|
| WO | 9520241 | A1 | 7/1995 |
| WO | 2008068691 | A2 | 6/2008 |
| WO | 2008155695 | A1 | 12/2008 |

* cited by examiner

*Primary Examiner* — Allen C. Ho

(74) *Attorney, Agent, or Firm* — Marie-Claire Maple

(57) ABSTRACT

An apparatus and method for magnetic control of an electron beam includes a control circuit having a first low voltage source and a second low voltage source. The control circuit also includes a first switching device coupled in series with the first low voltage source and configured to create a first current path with the first low voltage source when in a closed position and a second switching device coupled in series with the second low voltage source and configured to create a second current path with the second low voltage source when in a closed position. The control circuit further includes a capacitor coupled in parallel with an electron beam manipulation coil and positioned along the first and second current paths and a current source circuit electrically coupled to the electron beam manipulation coil and constructed to generate an offset current in the first and second current paths.

22 Claims, 14 Drawing Sheets

APPARATUS AND METHOD FOR MAGNETIC CONTROL OF AN ELECTRON BEAM

BACKGROUND OF THE INVENTION

Embodiments of the invention relate generally to diagnostic imaging and, more particularly, to an apparatus and method for magnetically controlling an electron beam (e-beam).

X-ray systems typically include an x-ray tube, a detector, and a support structure for the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in an x-ray scanner or computed tomography (CT) package scanner.

X-ray tubes include a rotating anode structure for the purpose of distributing the heat generated at a focal spot. The anode is typically rotated by an induction motor having a cylindrical rotor built into a cantilevered axle that supports a disc-shaped anode target and an iron stator structure with copper windings that surrounds an elongated neck of the x-ray tube. The rotor of the rotating anode assembly is driven by the stator.

An x-ray tube cathode provides an electron beam that is accelerated using a high voltage applied across a cathode-to-anode vacuum gap to produce x-rays upon impact with the anode. The area where the electron beam impacts the anode is often referred to as the focal spot. Typically, the cathode includes one or more cylindrical or flat filaments positioned within a cup for providing electron beams to create a high-power, large focal spot or a high-resolution, small focal spot, as examples. Imaging applications may be designed that include selecting either a small or a large focal spot having a particular shape, depending on the application. Typically, an electrically resistive emitter or filament is positioned within a cathode cup, and an electrical current is passed therethrough, thus causing the emitter to increase in temperature and emit electrons when in a vacuum.

The shape of the emitter or filament affects the focal spot. In order to achieve a desired focal spot shape, the cathode may be designed taking the shape of the filament into consideration. However, the shape of the filament is not typically optimized for image quality or for thermal focal spot loading. Conventional filaments are primarily shaped as coiled or helical tungsten wires for reasons of manufacturing and reliability. Alternative design options may include alternate design profiles, such as a coiled D-shaped filament. Therefore, the range of design options for forming the electron beam from the emitter may be limited by the filament shape, when considering electrically resistive materials as the emitter source.

Electron beam (e-beam) wobbling is often used to enhance image quality. Typically, wobble is achieved using electrostatic e-beam deflection. However, higher image quality can be achieved by using magnetic deflection. Wobbling via magnetic deflection may achieve a high image quality by ensuring that the electron beam moves from one position to the next usually as quickly as possible while staying in the desired position without straying. However, known systems that perform magnetic wobbling use complex topologies that often include bulky and expensive high voltage parts and do not achieve the fast and stable magnetic wobbling desired for enhanced image quality. Because each x-ray tube is not manufactured identically, wobble may differ from tube to tube. Further, adjustments to the magnitude of wobble in such systems is difficult to control.

Therefore, it would be desirable to develop an apparatus and method for magnetic deflection that overcomes the aforementioned drawbacks and achieves fast, stable, and adjustable e-beam magnetic control.

BRIEF DESCRIPTION OF THE INVENTION

Embodiments of the invention are directed to an apparatus and method for magnetically controlling an electron beam (e-beam).

Therefore, in accordance with one aspect of the invention, a control circuit for an electron beam manipulation coil for an x-ray generation system includes a first low voltage source and a second low voltage source. The control circuit also includes a first switching device coupled in series with the first low voltage source and configured to create a first current path with the first low voltage source when in a closed position and a second switching device coupled in series with the second low voltage source and configured to create a second current path with the second low voltage source when in a closed position. The control circuit further includes a capacitor coupled in parallel with an electron beam manipulation coil and positioned along the first and second current paths and a current source circuit electrically coupled to the electron beam manipulation coil and constructed to generate an offset current in the first and second current paths.

In accordance with another aspect of the invention, a method for driving an electron beam manipulation coil includes the steps of (A) closing a first switching device to cause a first current at a first polarity to flow along a first current path, through a resonance circuit, and through a first energy storage device, the resonance circuit comprising an electron beam manipulation coil and a resonance capacitor; and (B) opening the first switching device after closing the first switching device to initiate a first resonance cycle in the resonance circuit. The method also includes the steps of (C) closing a second switching device after the first resonance cycle has been initiated to cause a second current at a second polarity to flow along a second current path, through the resonance circuit, and through a second energy storage device; and (D) controlling switching of a current source circuit to cause a shift in the first current and a shift in the second current such that an average of the shifted first current and the shifted second current is non-zero.

In accordance with another aspect of the invention, a CT system includes a gantry having an opening therein for receiving an object to be scanned, a table positioned within the opening of the rotatable gantry and moveable through the opening, and an x-ray tube coupled to the rotatable gantry and configured to emit a stream of electrons toward a target, the target positioned to direct a beam of x-rays toward a detector. The CT system also includes a deflection coil mounted on the x-ray tube and positioned to deflect the stream of electrons. A control circuit is electrically coupled to the deflection coil. The control circuit includes a first low voltage source sized to supply steady-state current at a first polarity and a second low voltage source sized to supply steady-state current at a second polarity, opposite the first polarity. The control circuit also includes a first switch coupled to the first low voltage source and configured to create a first current path with the first low voltage source when the first switch is closed, and a second switch coupled to the second low voltage source and configured to create a second current path with the second low voltage source when the second switch is closed. A resonance capacitor is coupled in parallel with the deflection coil and positioned along the first and second current paths. A current shifting circuit electrically is coupled to the deflection coil and configured to inject a current offset in the first and second current paths. A controller is electrically coupled to the control circuit and programmed to control switching of the first and second switches.

Various other features and advantages will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

The operating environment of embodiments of the invention is described with respect to a sixty-four-slice computed tomography (CT) system. However, it will be appreciated by those skilled in the art that embodiments of the invention are equally applicable for use with other multi-slice configurations. Moreover, embodiments of the invention will be described with respect to the detection and conversion of x-rays. However, one skilled in the art will further appreciate that embodiments of the invention are equally applicable for the detection and conversion of other high frequency electromagnetic energy. Embodiments of the invention will be described with respect to a "third generation" CT scanner, but is equally applicable with other CT systems, surgical C-arm systems, and other x-ray tomography systems as well as numerous other medical imaging systems implementing an x-ray tube, such as x-ray or mammography systems.

Figure 1:
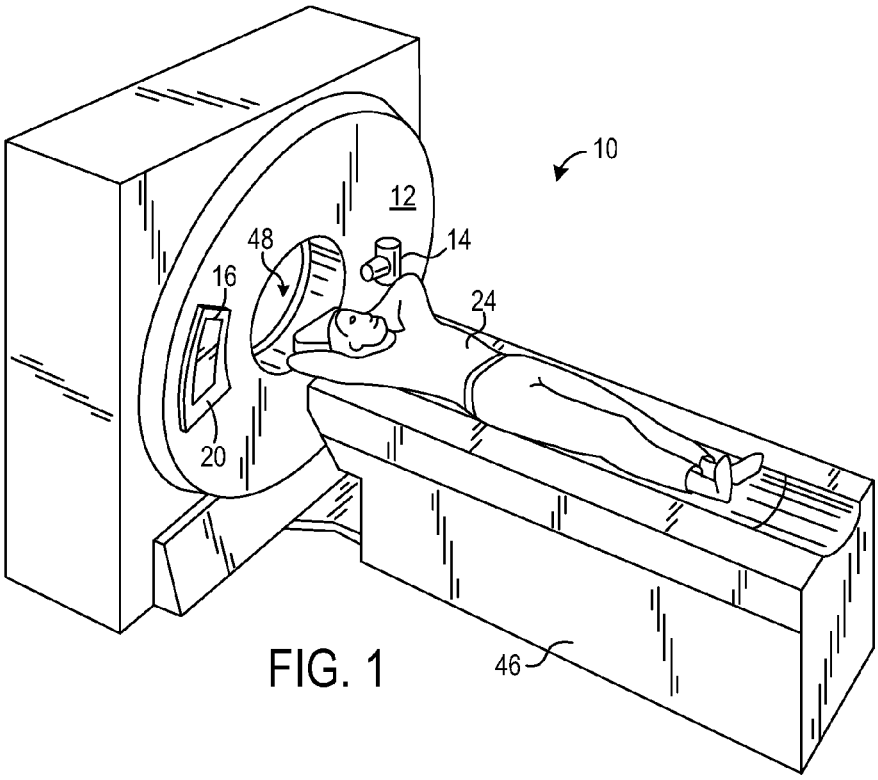
FIG. 1 is a pictorial view of an imaging system.

FIG. 1 is a block diagram of an embodiment of an imaging system 10 designed both to acquire original image data and to process the image data for display and/or analysis in accordance with the embodiments of the invention. It will be appreciated by those skilled in the art that the embodiments of the invention is applicable to numerous medical imaging systems implementing an x-ray tube, such as x-ray or mammography systems. Other imaging systems such as computed tomography systems and digital radiography systems, which acquire image three dimensional data for a volume, also benefit from the embodiments of the invention. The following discussion of x-ray system 10 is merely an example of one such implementation and is not intended to be limiting in terms of modality.

Figure 2:
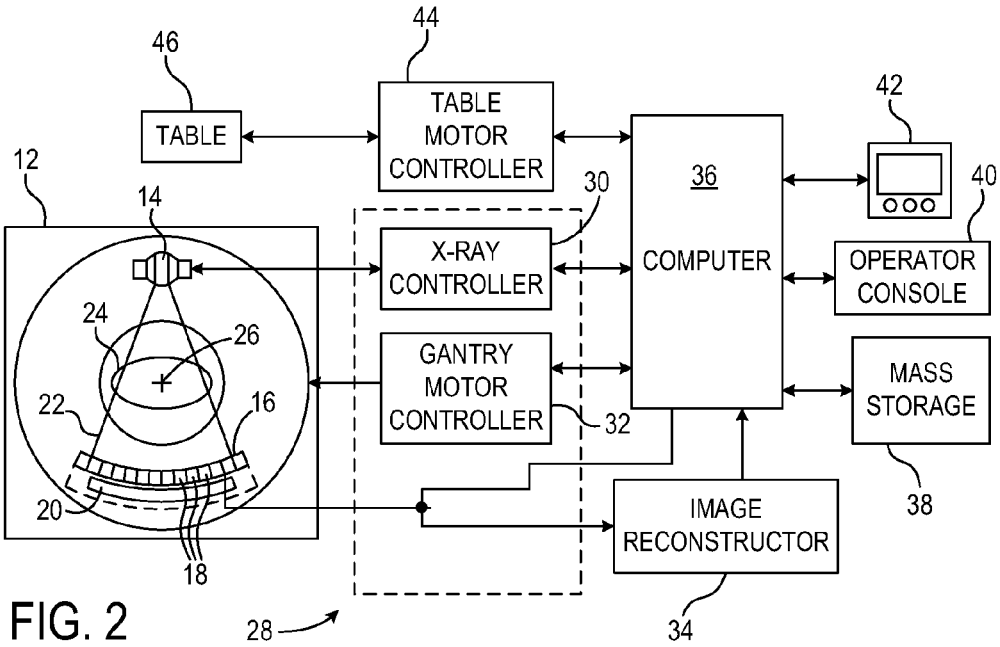
FIG. 2 is a block schematic diagram of the system illustrated in FIG. 1.

Referring to FIG. 1, a computed tomography (CT) imaging system 10 is shown as including a gantry 12 representative of a "third generation" CT scanner. Gantry 12 has an x-ray tube assembly or x-ray source assembly 14 that projects a cone beam of x-rays toward a detector assembly 16 on the opposite side of the gantry 12. Referring now to FIG. 2, detector assembly 16 is formed by a plurality of detectors 18 and data acquisition systems (DAS) 20. The plurality of detectors 18 sense the projected x-rays 22 that pass through a medical patient 24, and DAS 20 converts the data to digital signals for subsequent processing. Each detector 18 produces an analog electrical signal that represents the intensity of an impinging x-ray beam and hence the attenuated beam as it passes through the patient 24. During a scan to acquire x-ray projection data, gantry 12 and the components mounted thereon rotate about a center of rotation 26.

Rotation of gantry 12 and the operation of x-ray source assembly 14 are governed by a control mechanism 28 of CT system 10. Control mechanism 28 includes an x-ray controller 30 that provides power and timing signals to an x-ray source assembly 14 and a gantry motor controller 32 that controls the rotational speed and position of gantry 12. An image reconstructor 34 receives sampled and digitized x-ray data from DAS 20 and performs high speed reconstruction. The reconstructed image is applied as an input to a computer 36 which stores the image in a mass storage device 38.

Computer 36 also has software stored thereon corresponding to electron beam positioning and magnetic field control, as described in detail below.

Computer 36 also receives commands and scanning parameters from an operator via console 40 that has some form of operator interface, such as a keyboard, mouse, voice activated controller, or any other suitable input apparatus. An associated display 42 allows the operator to observe the reconstructed image and other data from computer 36. The operator supplied commands and parameters are used by computer 36 to provide control signals and information to DAS 20, x-ray controller 30 and gantry motor controller 32. In addition, computer 36 operates a table motor controller 44 which controls a motorized table 46 to position patient 24 and gantry 12. Particularly, table 46 moves patient 24 through a gantry opening 48 of FIG. 1 in whole or in part.

Figure 3:
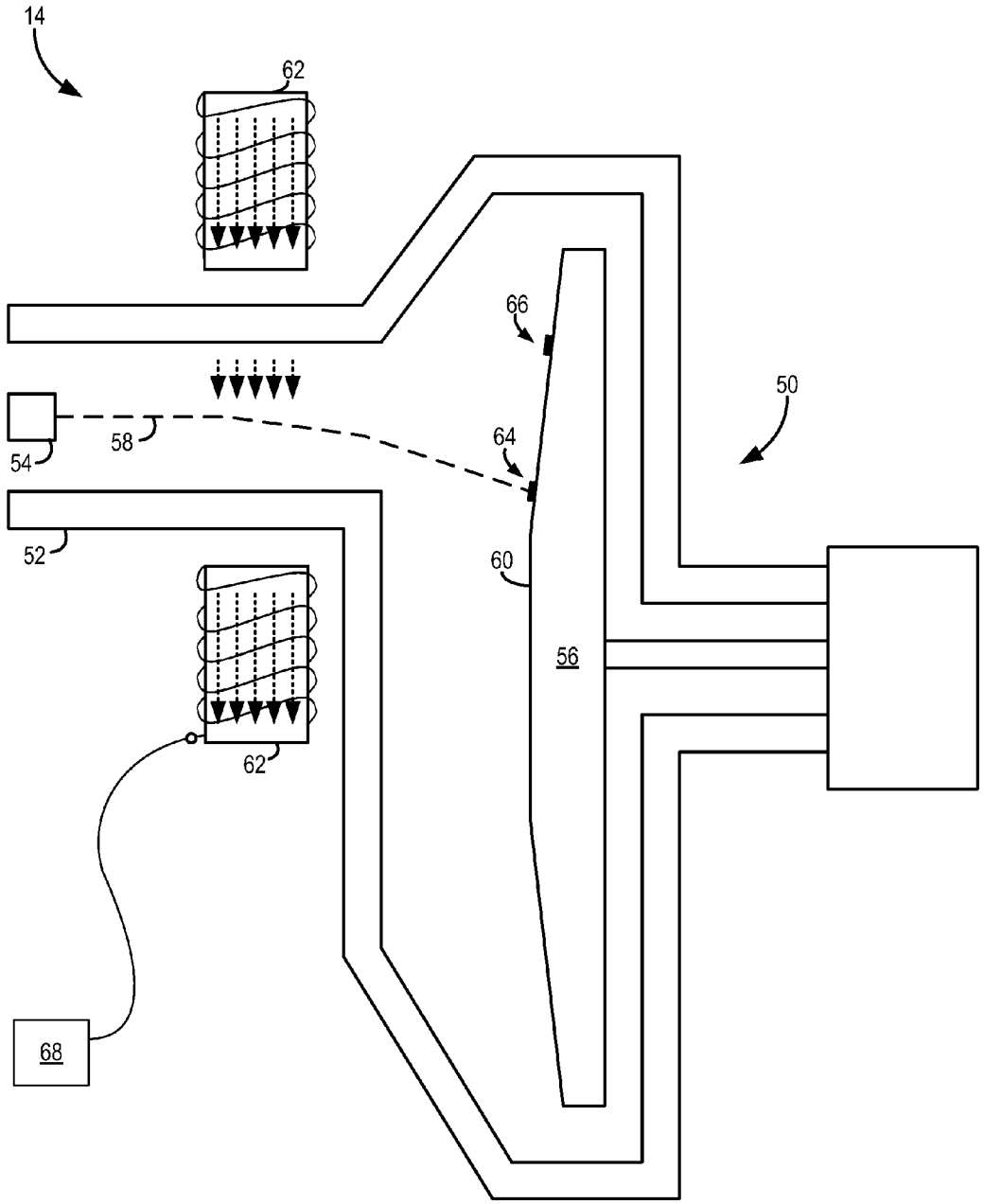
FIG. 3 is a cross-sectional view of an x-ray tube assembly according to an embodiment of the invention and useable with the imaging system illustrated in FIG. 1.

FIG. 3 illustrates a cross-sectional view of x-ray tube assembly 14 according to an embodiment of the invention. X-ray tube assembly 14 includes an x-ray tube 50 that includes a vacuum chamber or frame 52 having a cathode assembly 54 and a target or rotating anode 56 positioned therein. Cathode assembly 54 is comprised of a number of separate elements, including a cathode cup (not shown) that supports the filament (not shown) and serves as an electrostatic lens that focuses a beam of electrons 58 emitted from the heated filament toward a surface 60 of target 56.

A deflection coil 62 is mounted in x-ray tube assembly 14 at a location near the path of electron beam 58. According to one embodiment, deflection coil 62 is wound as a solenoid and is positioned over and around vacuum chamber 52 such that the magnetic field created is in the path of electron beam 58. Deflection coil 62 generates a magnetic field that acts on electron beam 58, causing electron beam 58 to deflect and move between a pair of focal spots or positions 64, 66. The direction of movement of electron beam 58 is determined by the direction of current flow though deflection coil 62, which is controlled via a control circuit 68 coupled to deflection coil 62, as described in more detail with respect to FIGS. 3-4.

Figure 4:
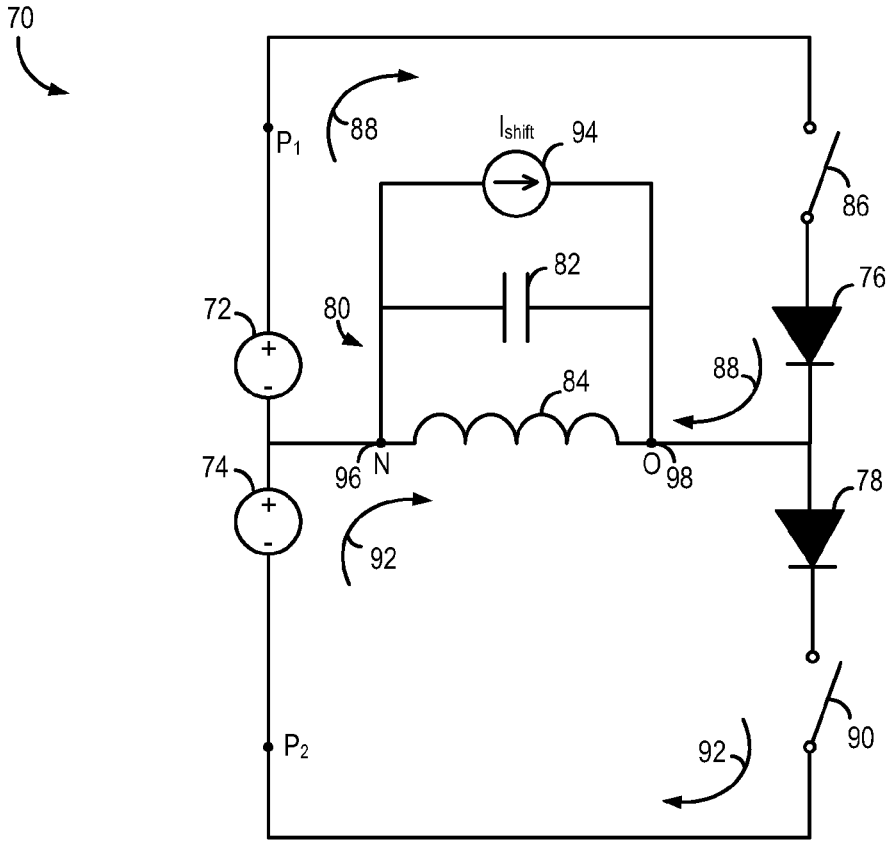
FIG. 4 is an electrical circuit diagram of a resonance circuit incorporating an ideal current source circuit according to an embodiment of the invention.

FIG. 4 illustrates a control circuit 70 for an x-ray tube assembly, such as control circuit 68 provided in x-ray tube assembly 14 of FIG. 3. Control circuit 70 includes a first low voltage source or supply 72 and a second low voltage source supply 74. Control circuit 70 also includes a pair of diodes 76, 78, a resonant circuit 80 comprising a resonant capacitor 82 in parallel with a load 84, such as, for example, deflection coil 62 of FIG. 3. A first switch 86, which is closeable to form a first current path 88, and a second switch 90, which is closeable to form a second current path 92, are also provided in control circuit 70. According to one embodiment, first and second low voltage supplies 72, 74 are constructed to supply a voltage of approximately R*I volts, where R represents an overall parasitic resistance of the control circuit and load 84, and I represents a desired steady state current supplied to load 84. However, one skilled in the art will recognize that voltage sources 72, 74 may be selected based on a desired magnitude of applied current. According to one various embodiments, the magnitude of power supplies 72, 74 may be independently adjusted according to the desired current shift.

In operation, switches 86, 90 are selectively opened and closed to generate a magnetic field in coil 84 to control deflection of an electron beam. Initially first switch 86 is closed while second switch 90 is held open, resulting in a first current, $I_{high}$, across load 84. When first switch 86 is opened energy stored in resonant capacitor 82 begins discharging. As resonant capacitor 82 discharges, voltage and current drop, and resonance develops between resonant capacitor 82 and load 84. During the resonance cycle, resonant capacitor 82 recovers some charge. Second switch 90 is closed based on a desired voltage condition, such as when the voltage across the resonant capacitor 82 becomes negative. After second switch 90 is closed and the voltage across the resonant capacitor 82 equals voltage supply 74, the resonance cycle ends, resulting in a second current, $I_{low}$, across load 84. When second switch 90 is reopened, energy stored in resonance capacitor 82 begins discharging, triggering a second resonance cycle. After the voltage becomes positive, first switch 86 is closed, and the switching cycle repeats. According to one embodiment, the switching time is fixed at approximately 10 microseconds. The switching time is related to the value of the resonant capacitor 82 and the inductance of the load 84.

Accordingly, control circuit 70 achieves fast current inversion using a low voltage source by taking advantage of the resonance cycle that is triggered when a capacitor is connected in parallel with a deflection coil and when a pair of switches is controlled to open and close at specified points on voltage and current diagrams. Further, control circuit 70 is able to achieve the fast current inversion with controlled or minimized resistive losses. Switching losses are limited during current inversion due to the resonant commutation, and overall conduction losses are limited because only two switches are used in the control circuit. Further, the voltage developed in load 84 is very sinusoidal, resulting in low electromagnetic interference (EMI). Also, the coil current has very little variance (e.g., less than one percent), which results in very stable wobbling and a constant e-beam position during data collection.

Control circuit 70 also includes an ideal current source 94, which is connected across load 84 from point N 96 to point O 98. Ideal current source 94 can introduce a positive or negative shift on current flow thus increasing or decreasing average coil (load) current. Thus, the addition of ideal current source 94 adds an offset, $I_{shift}$, to the load current during operation. For example, assuming first low voltage supply 72 is selected such that load current has a value of $I_{high}$ when switch 86 is closed and second low voltage supply 74 is selected such that load current has a value of $I_{low}$ when switch 90 is closed, ideal current source 94 injects an offset current into the circuit that changes the load current from $I_{high}$ to $I_{high}+I_{shift}$ during the time when switch 86 is closed and from $I_{low}$ to $I_{low}+I_{shift}$ during the time when switch 90 is closed. According to one embodiment, the absolute value of current shift, $I_{shift}$, may be greater than the absolute value of $I_{high}$ or $I_{low}$, resulting in an all positive or all negative current in coil 84. For example, in an embodiment where power supplies 72, 74 are selected such that $I_{high}$ is 4 amps and $I_{low}$ is −4 amps, a current shift, $I_{shift}$, of 2 amps would result in a 6 amp and −2 amp current in first and second current paths, 88, 92, respectively.

Adding ideal current source 94 to control circuit 70 has a number of advantages. First, ideal current source 94 may be used for calibration purposes during an initial installation or maintenance of an x-ray tube. For example, ideal current source 94 may be configured to shift current to correct an offset in the given x-ray tube. Additionally, the inclusion of ideal current source 94 adds an element of adjustability to the overall imaging system by allowing quick and easy adjustments in scanning parameters. For example, the same x-ray tube may be operated in two consecutive scanning protocols that include differing magnitudes of deflection or focus changes simply by altering the amount of current shift between scans.

According to one embodiment, operation of control circuit 70 is determined based on an input to an operator console, such as operator console 40 of FIG. 2. Based on the type of exam being performed, software loaded on a computer, such as computer 36 of FIG. 2, determines desired focal spot positions for the electron beam and calculates the magnetic field to be applied to direct the electron beam to the desired focal spot positions. A controller, such as controller 30 of FIG. 2, is programmed to transmit switching commands to control circuit 70 to generate the desired magnetic field.

Figure 5:
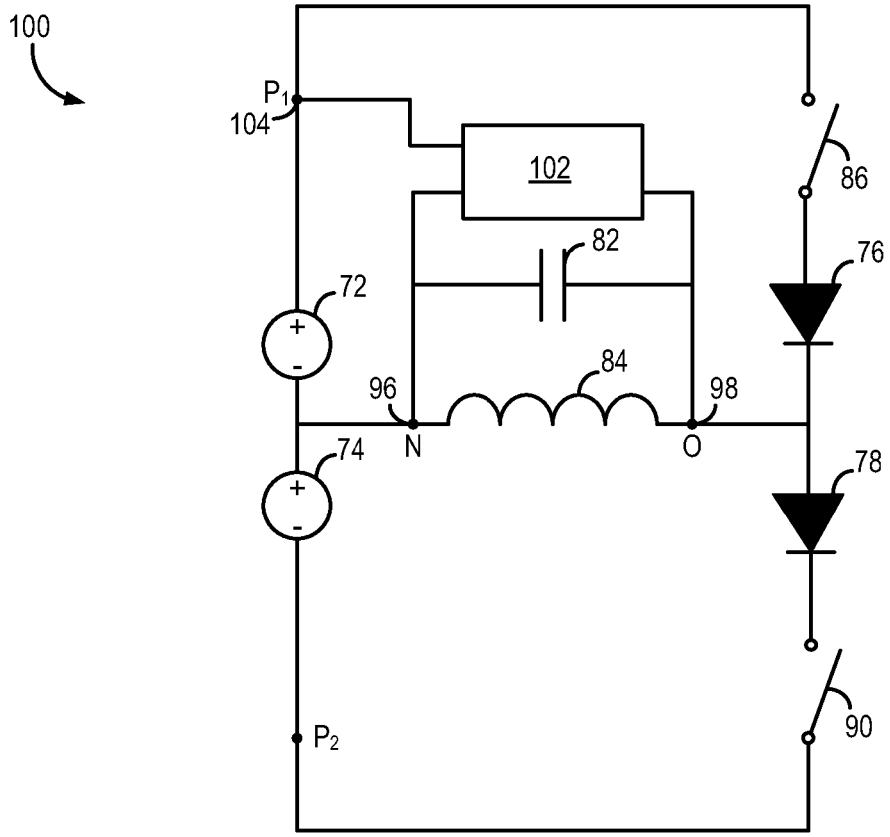
FIG. 5 is an electrical circuit diagram of a resonance circuit incorporating a real current source circuit according to an embodiment of the invention.

Referring now to FIG. 5, a control circuit 100 incorporating a real current source circuit 102 is shown according to an alternative embodiment. With the exception of real current source circuit 102, control circuit 100 is configured in a similar manner as circuit 70. Thus, in addition to real current source circuit 102, control circuit 100 includes a pair of voltage supplies 72, 74, a pair of switches 86, 90, a pair of diodes 76, 78, and a resonant capacitor 82 in parallel with a load 84. As shown, real current source circuit 102 is connected across load 84 from point N 96 to point O 98 and across low voltage supply 72 from point $P_1$ 104 to point N 96. Real current source circuit 102 is powered by low voltage supply 72, as described in detail with respect to FIG. 6.

Figure 6:
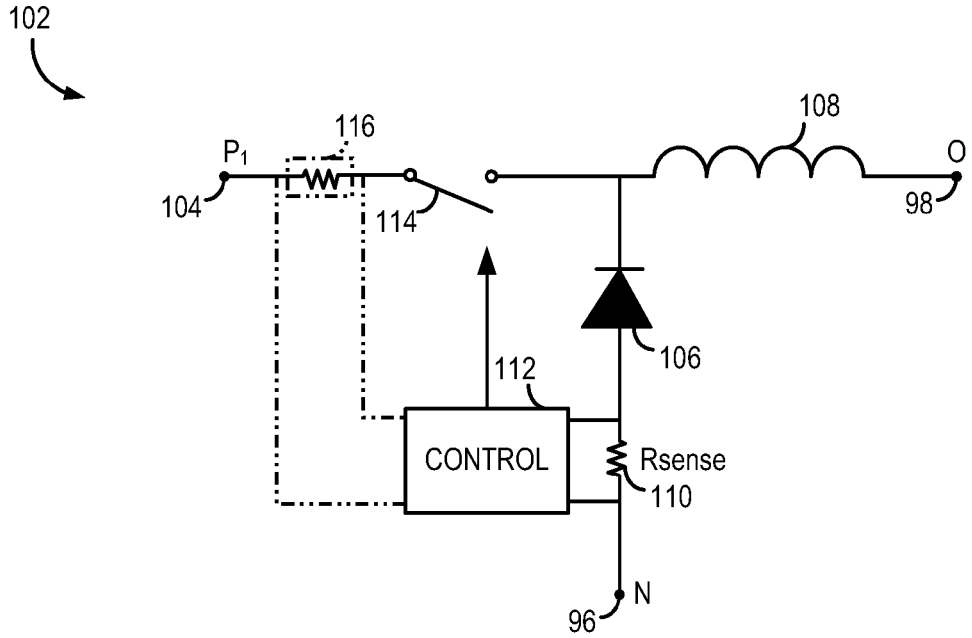
FIG. 6 is an electrical circuit diagram of the real current source circuit of FIG. 5.

Real current source circuit 102 is illustrated in detail in FIG. 6. Circuit 102 is a unidirectional circuit and, therefore, only produces current shifting in a positive direction (from point O 98 to point N 96) when coupled in the manner shown in FIG. 5. As shown, circuit 102 includes a diode 106, an inductor 108, and a current monitoring device such as a resistor, $R_{sense}$, 110 provided in parallel with a control 112. Control 112 opens and closes a switch 114 based on current flow through resistor 110. One skilled in the art will recognize that FIG. 6 illustrates only one of many possible implementations of a unidirectional circuit.

Referring to FIGS. 5 and 6 together, when switch 114 is closed, first low voltage supply 72 causes current to flow through and charge inductor 108, and load 84. When switch 114 is opened, current continues to flow through inductor 108 and load 84, causing the current to flow through resistor 110 and diode 106. Control 112 monitors or senses current flow via resistor 110, and when current through inductor 108 and resistor 110 drops below the desired current offset such that the voltage across resistor 110 falls below a threshold, control 112 sends a switching command to close switch 114 to recharge inductor 108. In one embodiment, control 112 closes switch 114 for a predetermined time period, such as, for example 5 microseconds. After that period, switch 114 is opened and control 112 rechecks the voltage across resistor 110. If the voltage has not reached the desired level, switch 114 is closed again for the predetermined time period. This process is repeated until current flow through resistor 110 causes the voltage across resistor 110 to reach the desired level. Accordingly, control 112 operates switch 114 to approximately maintain a steady-state shift in the coil current. Alternatively, control 112 may be configured to measure a voltage across an optional second resistor 116 (shown in phantom) positioned between point $P_1$ 104 and switch 114 to determine when to open switch 114 and, therefore, to cease charging inductor 108. The inclusion of real current source circuit 102 adds a positive current offset to current flow through coil 84. The desired level of current offset or the threshold may be set by a computer, such as computer 36 (FIG. 1), or may be set by an operator, via a user interface of console 40, for example.

Figure 20:
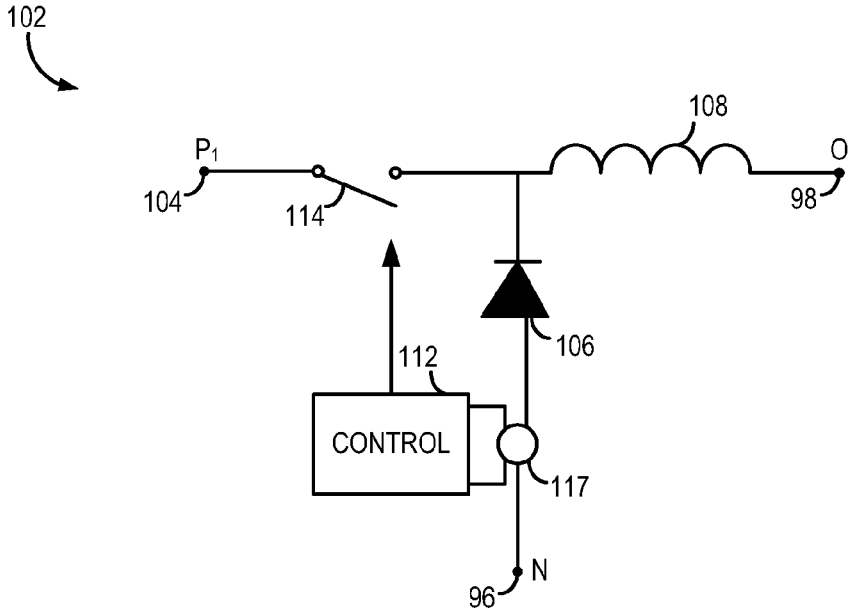
FIG. 20 is an electrical circuit diagram of a resonance circuit according to another embodiment of the invention.

FIG. 20 illustrates an alternative embodiment of real current source circuit 102 including a current probe 117 as the current monitoring device, in place of a resistor. One skilled in the art will recognize that current probe 117 may comprise any number of current monitoring devices, such as, for example, a magnetic probe or an Hall effect probe.

Figure 7:
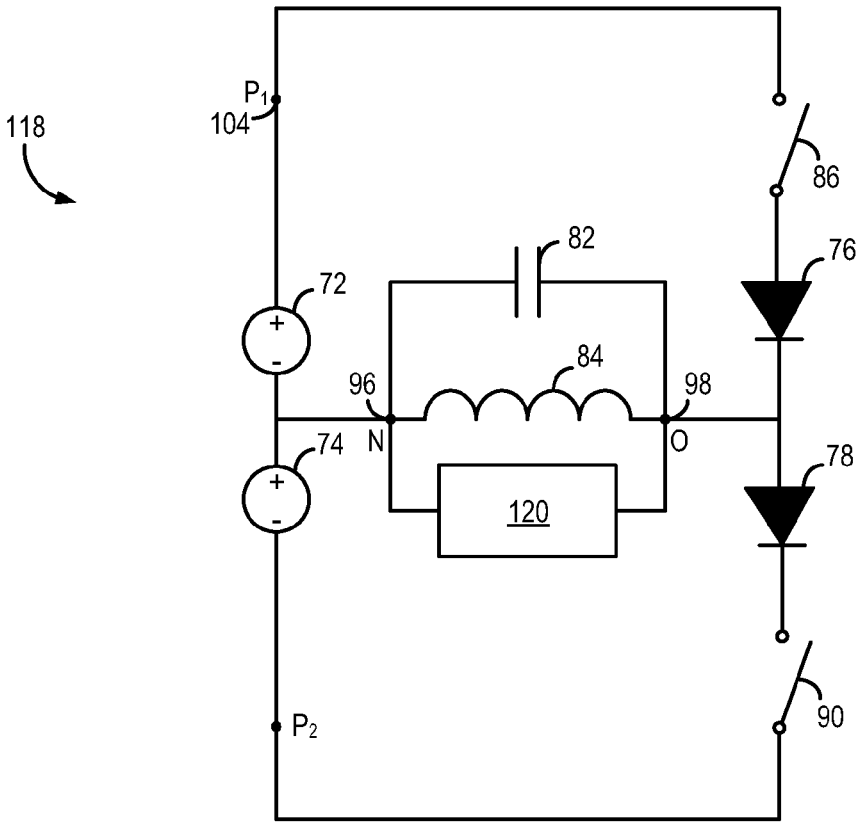
FIG. 7 is an electrical circuit diagram of a resonance circuit incorporating a real current source circuit according to another embodiment of the invention.

FIG. 7 illustrates a control circuit 118 incorporating a real current source circuit 120 in accordance with another embodiment of the invention. As shown, real current source circuit 120 is connected across load 84 from point N 96 to point O 98. Outside the components of real current source circuit 120, control circuit 118 contains the same components as control circuit 70.

Figure 8:
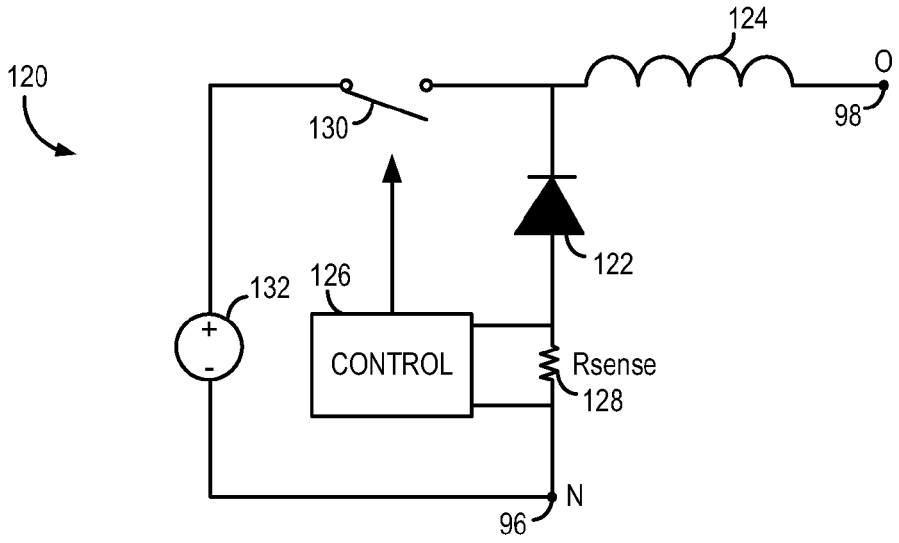
FIG. 8 is an electrical circuit diagram of the real current source circuit of FIG. 7.

Referring now to FIG. 8, real current source circuit 120 is shown in detail. Similar to real current source circuit 102, real current source circuit 120 includes a blocking diode 122, an inductor 124, and a control 126 connected in parallel with a resistor, $R_{sense}$, 128 and configured to control a switch 130. Real current source circuit 120 also includes an independent low voltage power source 132. Thus, real current source circuit 120 is powered by independent power source 132. Control 126 operates in a similar manner as control 112 (FIG. 6), sending switching commands to switch 130 based on current flow through resistor 128. Operation of real current source circuit 120 injects a positive shift in current across coil 84. One skilled in the art will recognize that the current sensing resistor can be replaced by any current sensing probe.

According to one embodiment, independent power source 132 is a low power source that has a magnitude unrelated to the magnitude of power supplies 72, 74. The inclusion of independent power supply 132 in circuit 120 increases the amount of possible current shift that may be injected in the coil current above what may be injected based on power supply 72 alone as described above with respect to FIGS. 5 and 6. Thus, independent power source 132 may be sized based on design specifications to provide any desired amount of current offset.

Figure 9:
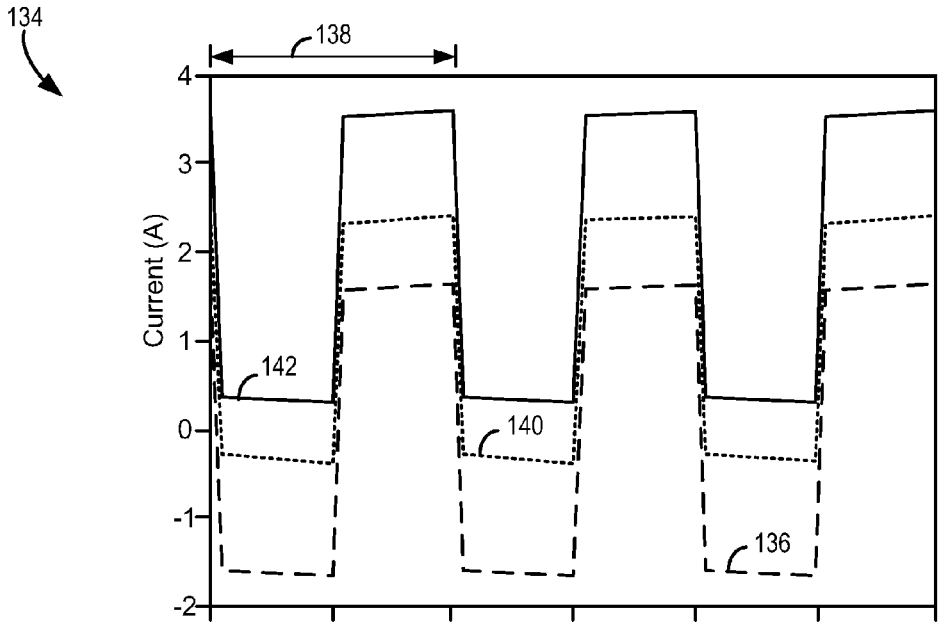
FIG. 9 is an exemplary graph of current developed in a load using the circuits of FIGS. 5-8.

FIG. 9 is an exemplary graph 134 of possible currents in load 84 according to embodiments of the invention. Coil current having no offset current flowing through load 84 is illustrated in FIG. 9 as curve 136. As shown, the alternating coil current is symmetrical about zero. Thus, the average current in a given period 138 of curve 136 is approximately zero. Coil current having a positive offset current flowing through load 84 that is less than the magnitude of curve 136 with respect to zero is illustrated in FIG. 9 as curve 140. As shown, the positive current offset has the effect of shifting curve 136 upwards, such that period 138 of curve 140 has a non-zero average. The current offset illustrated by curve 140 may be produced by either circuit 102 (FIG. 6) or circuit 120 (FIG. 8). Coil current having a positive offset current flowing through load 84 that is greater than the magnitude of curve 136 with respect to zero is illustrated in FIG. 9 as curve 142. As shown, the current offset responsible for curve 142 produces only positive currents to flow through load 84 during either alternating cycle such that the minimum current and the maximum current have the same polarity. The current offset illustrated by curve 142 may be produced by circuit 120.

Figure 10:
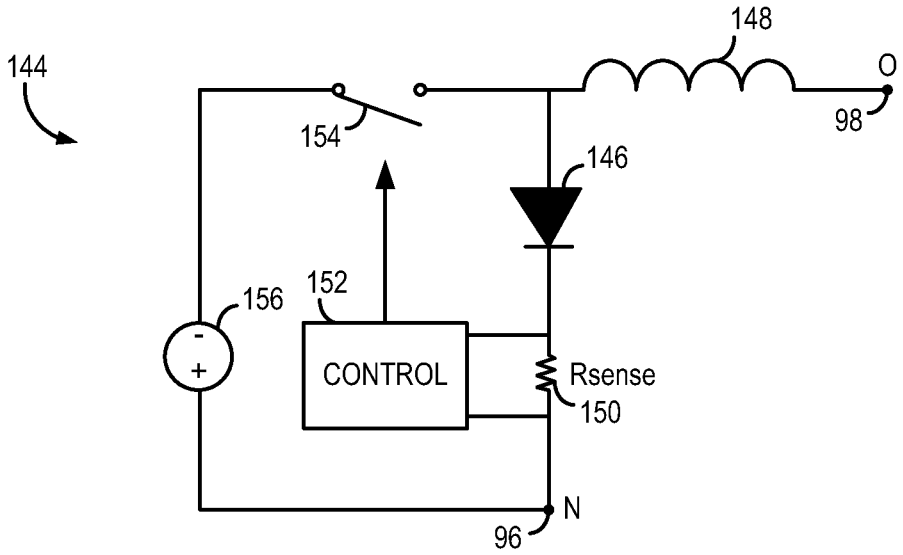
FIG. 10 is an electrical circuit diagram of an alternative real current source circuit useable in the resonance circuit of FIG. 7.

FIG. 10 illustrates a real current source circuit 144 that can be incorporated into control circuit 118 of FIG. 7 as an alternative to real current source circuit 120 (FIGS. 7 and 8). Real current source circuit 144 is constructed with similar components as circuit 120 and includes a blocking diode 146, an inductor 148, and a resistor 150 connected in parallel with a control 152 that sends signals to a switch 154. Real current source circuit 144 also includes an independent low voltage power source 156. Thus, real current source circuit 144 is powered by independent power source 156. Diode 146 is positioned in the opposite direction as diode 122 (FIG. 8), and the polarity of independent power source 156 is opposite the polarity of independent power supply 132 (FIG. 8) since the current flow (i.e., from point N 96 to point O 98) in circuit 120 (FIG. 8) is opposite the direction of current flow (i.e., from point O 98 to point N 96) in circuit 144. Therefore, real current source circuit 144 injects a negative current shift into control circuit 118 (FIG. 7).

Figure 11:
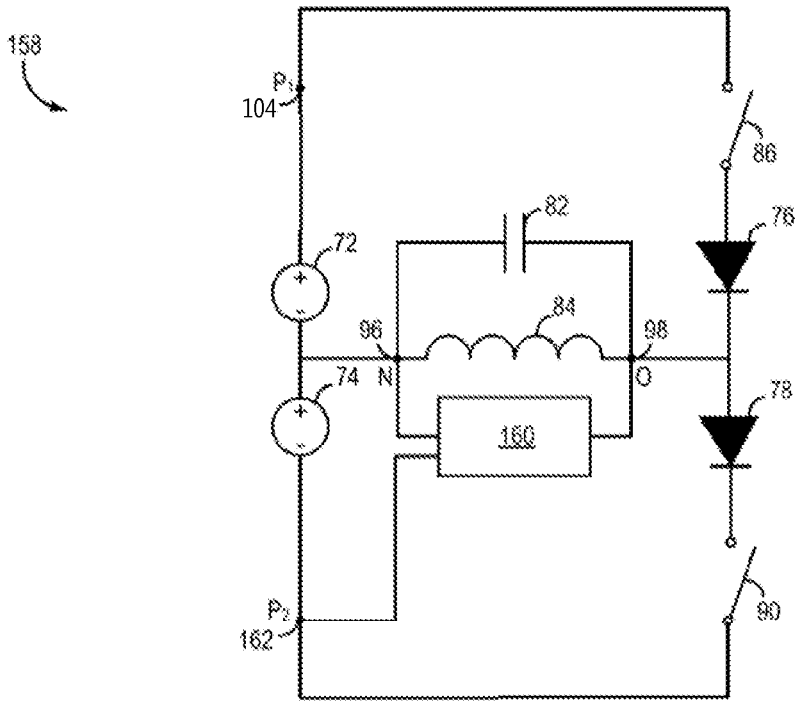
FIG. 11 is an electrical circuit diagram of a resonance circuit incorporating a real current source circuit according to an embodiment of the invention.

Referring now to FIG. 11, a control circuit 158 incorporating a unidirectional real current source circuit 160 that injects a negative current shift is shown according to an alternative embodiment. Control circuit 158 is configured with a resonant capacitor 82, load 84, voltage sources 72, 74, diodes 76, 78, and switches 86, 90, in a similar manner as control circuit 70 (FIG. 4). Real current source circuit 160 connects across load 84 from point N 96 to point O 98 and connects across second low voltage supply 74 from point N 96 to point $P_2$ 162.

Figure 12:
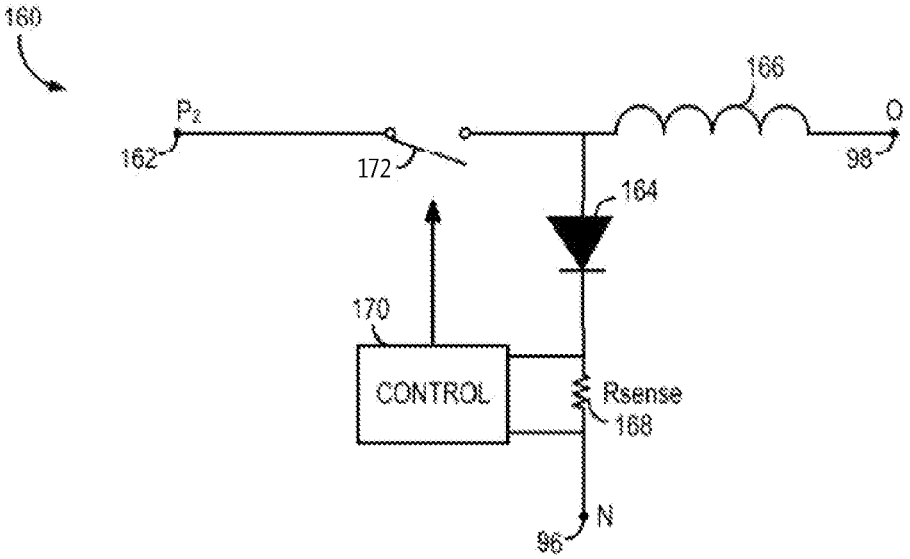
FIG. 12 is an electrical circuit diagram of the real current source circuit of FIG. 11.

FIG. 12 illustrates real current source circuit 160 in detail. Similar to circuit 102 (FIG. 6), real current source circuit 160 is a unidirectional circuit that includes a diode 164, an inductor 166, and a resistor 168 connected to a control 170 that sends signals to a switch 172 in a similar manner as described with respect to circuit 102. However, unlike circuit 102, which shifts current in a positive direction, real current source circuit 160 produces a current offset in a negative direction. Thus, diode 164 is positioned in the opposite direction as diode 106 of FIG. 6 to allow current to flow from point O 98 to point N 96 and to block current flow in the opposite direction.

Figure 13:
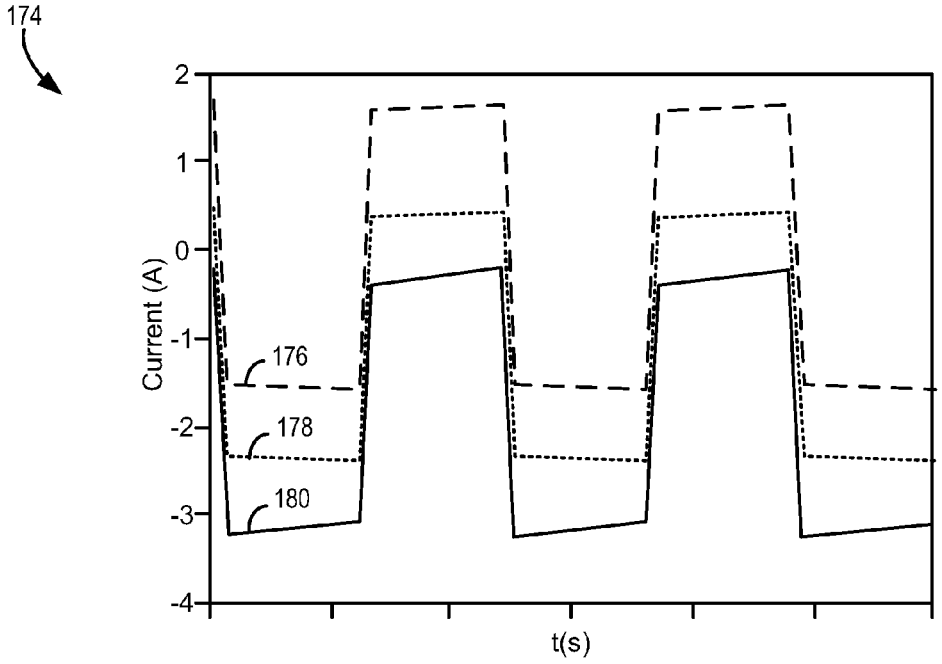
FIG. 13 is an exemplary graph of current developed in a load using the circuits of FIGS. 10-12.

Referring to FIG. 13, an exemplary graph 174 is shown, illustrating possible currents in load 84 according to embodiments of the invention. Coil current having no offset current flowing through load is illustrated as curve 176. As shown, the alternating coil current is symmetrical about zero. Coil current having a negative offset current flowing through load 84 that is less than the magnitude of curve 176 with respect to zero is illustrated as curve 178. The current offset illustrated by curve 176 may be produced by either circuit 144 (FIG. 10) or circuit 160 (FIG. 12). Coil current having a negative offset current flowing through load 84 that is greater than the magnitude of curve 176 with respect to zero is shown on curve 180. As shown, the current offset responsible for curve 180 produces only negative currents to flow through load 84 during either alternating cycle such that the minimum current and the maximum current have the same polarity. The current offset illustrated by curve 180 may be produced by circuit 144.

Figure 14:
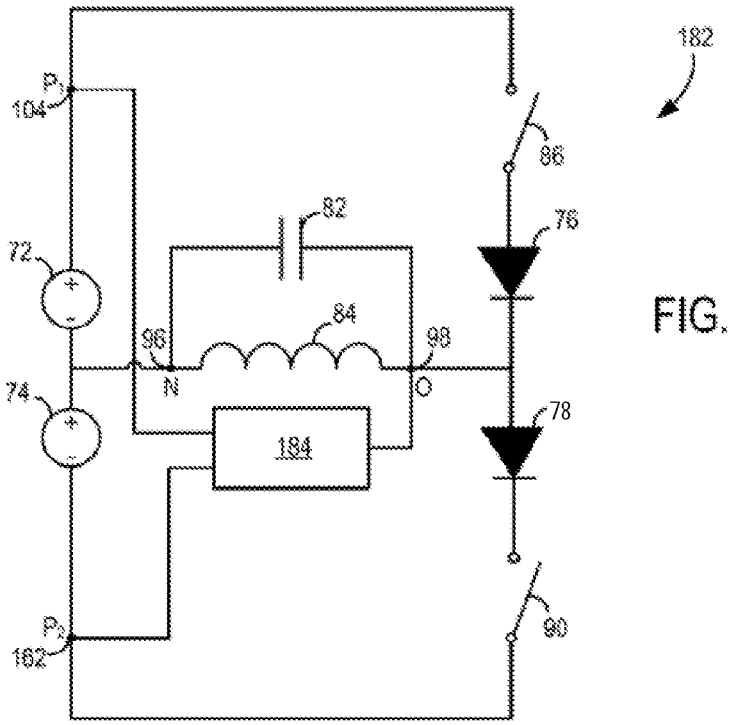
FIG. 14 is an electrical circuit diagram of a resonance circuit incorporating a bidirectional current source circuit according to an embodiment of the invention.

Referring to FIG. 14, a control circuit 182 is shown according to yet another embodiment. Control circuit 182 includes a pair of voltage supplies 72, 74, a pair of switches 86, 90, a pair of diodes 76, 78, and a resonant capacitor 82 in parallel with a load 84, similar to FIG. 4. A bidirectional current source circuit 184 is also included in control circuit 182 to generate positive and negative current shifts in the current flow through load 84. Current source circuit 184 is connected at point O 98 and across voltage supplies 72, 74 at point $P_1$ 104 and point $P_2$ 162.

Figure 15:
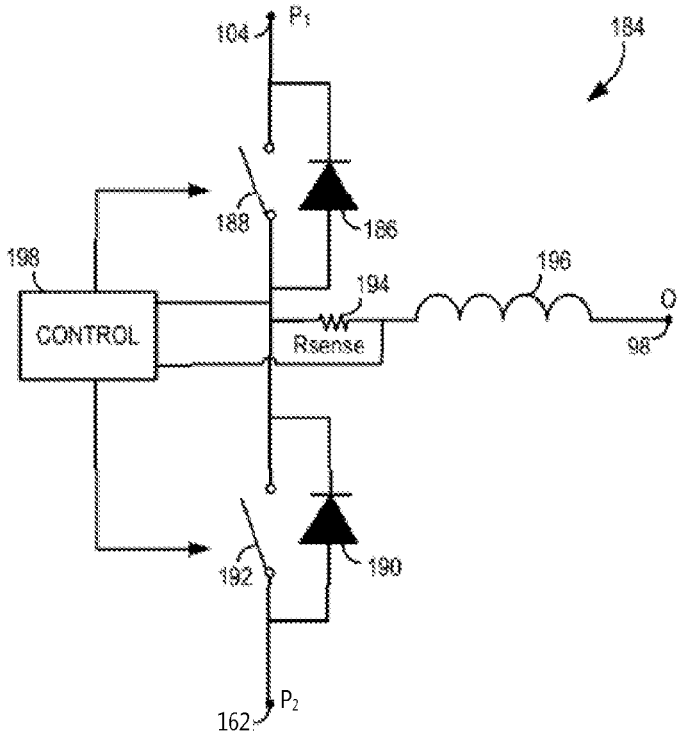
FIG. 15 electrical circuit diagram of the bidirectional current source circuit of FIG. 14.

A circuit diagram of bidirectional current source circuit 184 is provided in FIG. 15. As shown, real current source circuit 184 includes a first diode 186 in parallel with a first switch 188, a second diode 190 in parallel with a second switch 192, a resistor 194, an inductor 196, and a control 198 connected across resistor 194 and configured to control opening and closing of first and second switches 188, 192. In operation, control 198 generates a signal that turns on one of switches 188, 192 depending on the sign of the desired current shift. For example, for an application in which a positive current shift is desired, control 198 operates switch 188 in a similar manner as described with respect to current control circuit 102 (FIG. 6). For an application in which a negative current shift is desired, on the other hand, control 198 monitors resistor 194 and selectively opens and closes switch 192 to maintain a desired charge in inductor 196.

Figure 16:
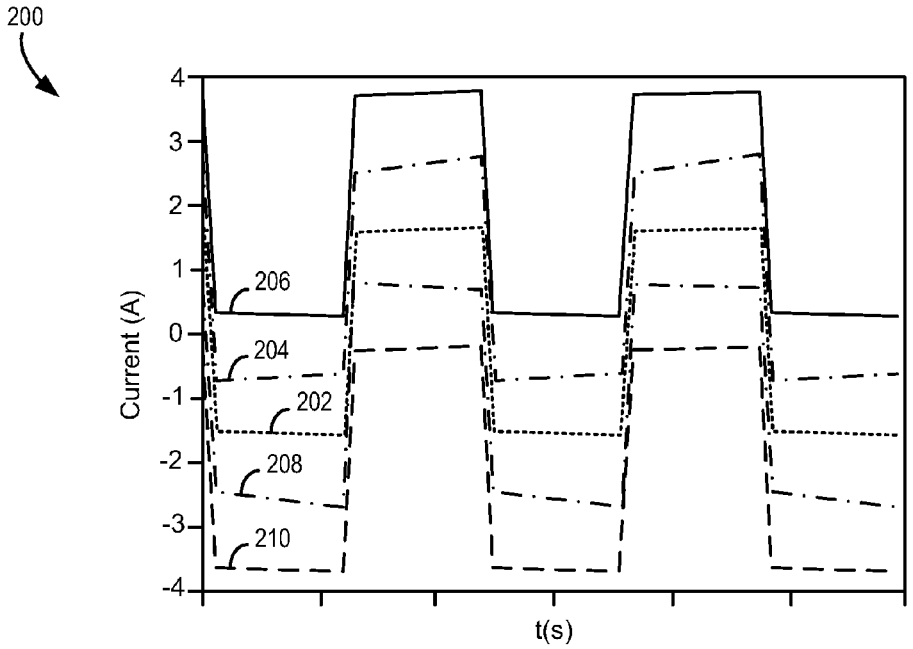
FIG. 16 is an exemplary graph of current developed in a load using the circuits of FIGS. 14-15.

FIG. 16 includes an exemplary graph 200 of possible currents in a load, such as load 84 of FIG. 14, resulting from operation of a bidirectional current source circuit, such as circuit 184 (FIG. 14). Coil current having no offset current flowing through load is illustrated in curve 202. A bidirectional circuit may be controlled to shift coil current in a positive direction or in a negative direction. Therefore, a bidirectional circuit may be controlled to produce a positive current offset that is less than the magnitude of curve 202 with respect to zero, as shown on curve 204, or produce a positive current having an magnitude that is approximately equal to the amplitude of curve 204 with respect to zero such that coil current is completely positive, as shown on curve 206. Likewise, a bidirectional circuit may be controlled to produce a negative current offset that is less than the amplitude of curve 202, as shown on curve 208, or produce an offset current that shifts coil current in a negative direction such that coil current is completely negative, as shown on curve 210.

Figure 17:
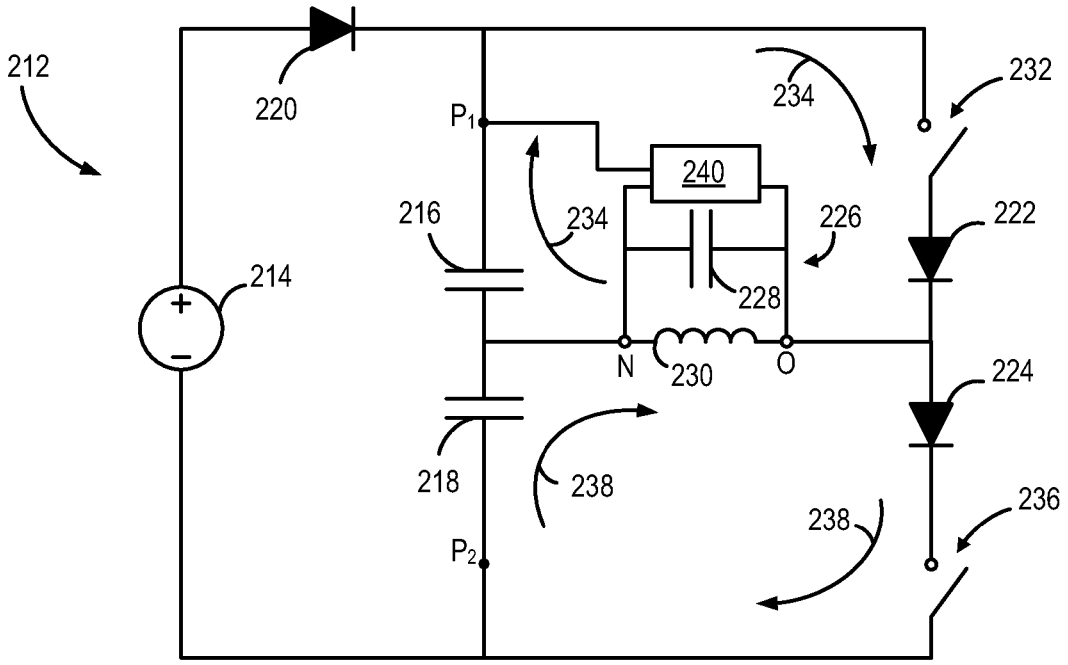
FIG. 17 is an electrical circuit diagram of a resonance circuit according to an embodiment of the invention.

FIG. 17 illustrates a control circuit 212 for an x-ray tube assembly, according to another embodiment of the invention. Control circuit 212 includes a voltage source 214 that provides a supply voltage to a first capacitor or low voltage power supply 216 and a second capacitor or low voltage power supply 218. A blocking diode 220 is positioned between voltage source 214 and first low voltage source 216 to prevent the backward flow of current into voltage source 214. Control circuit 212 also includes first and second diodes 222, 224 and a resonant circuit 226 comprising a resonant capacitor 228 positioned in parallel with a load 230. A first switch 232, which is closeable to form a first current path 234, and a second switch 236, which is closeable to form a second current path 238, are also provided in control circuit 212. Control circuit 212 also includes a unidirectional real current source circuit 240 configured to inject a positive current offset, similar to real current source circuit 102 described with respect to FIGS. 5 & 6.

Figure 18:
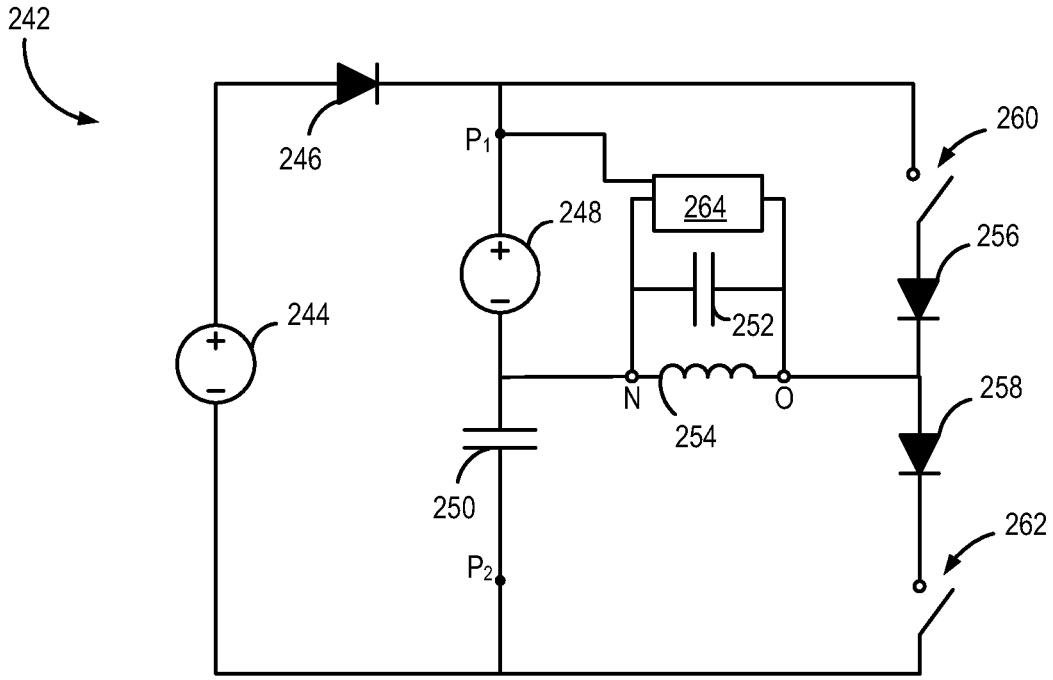
FIG. 18 is an electrical circuit diagram of a resonance circuit according to another embodiment of the invention.

Referring now to FIG. 18, a control circuit 242 is illustrated according to an alternative embodiment of the invention. Control circuit 242 includes a first voltage supply 244, a blocking diode 246, a second voltage supply 248, a capacitor 250, a resonant capacitor 252 in parallel with a coil 254, a pair of diodes 256, 258, and a pair of switches 260, 262. Thus, control circuit 242 differs from control circuit 212 of FIG. 17 in that one of the two series capacitors 216, 218 of FIG. 17 is replaced by low voltage supply 248. Control circuit 242 also includes a unidirectional real current source circuit 264 configured to inject a positive current offset, similar to real current source circuit 102 described with respect to FIGS. 5 & 6.

While FIGS. 17 and 18 are described as including unidirectional real current source circuits that inject a positive current offset, one skilled in the art will recognize that control circuit 212 and control circuit 242 could easily be configured to include a unidirectional circuit that injects a negative current offset, similar to real current source circuit 120 (FIGS. 7 and 8), real current source circuit 160 (FIGS.

11 and 12), or real current source circuit 144 (FIG. 10). Alternatively, control circuits 212, 242 may be modified to include a bidirectional real current source circuit capable of injecting positive and negative current offsets, such as real current source circuit 184 (FIGS. 14 and 15), for example.

Embodiments of the invention described above use a single deflection coil and corresponding control circuit to deflect an electron beam between two focal spots. As would readily be understood by one skilled in the art, such a configuration could be used to deflect an electron beam between two focal spots separated by a desired distance in a desired direction with respect to the anode. For example, a control circuit coupled to the deflection coil may be configured to deflect an electron beam between two points along an x-axis (i.e., in an x-direction).

According to another embodiment of the invention, an x-ray tube assembly may include multiple deflection coils each having its own control circuit. In such a multiple deflection coil embodiment, two or more deflection coils and their respective control circuits may be configured to deflect the electron beam in multiple directions. For example, a first deflection coil/control circuit assembly may cause the electron beam to deflect between two points in a first direction (e.g., along an x-axis), and a second deflection coil/control circuit assembly may cause the electron beam to deflect between two points in a second direction (e.g., along a z-axis).

Embodiments of the invention described herein also may be used in a control circuit for dynamic magnetic focusing of an electron beam with a focusing coil. Dynamic magnetic focusing is used when the accelerating voltage between the cathode and the target is rapidly changed between two values, such as, for example, in dual energy imaging. When the accelerating voltage is rapidly changed, the electron beam ideally maintains focus on the target without changing the geometrical features of the focal spot. In order to maintain the geometry of the focal spot, the focusing magnetic field, and in turn the current through the focusing coil, is adjusted between two values: the value for low voltage and the value for high voltage.

Figure 19:
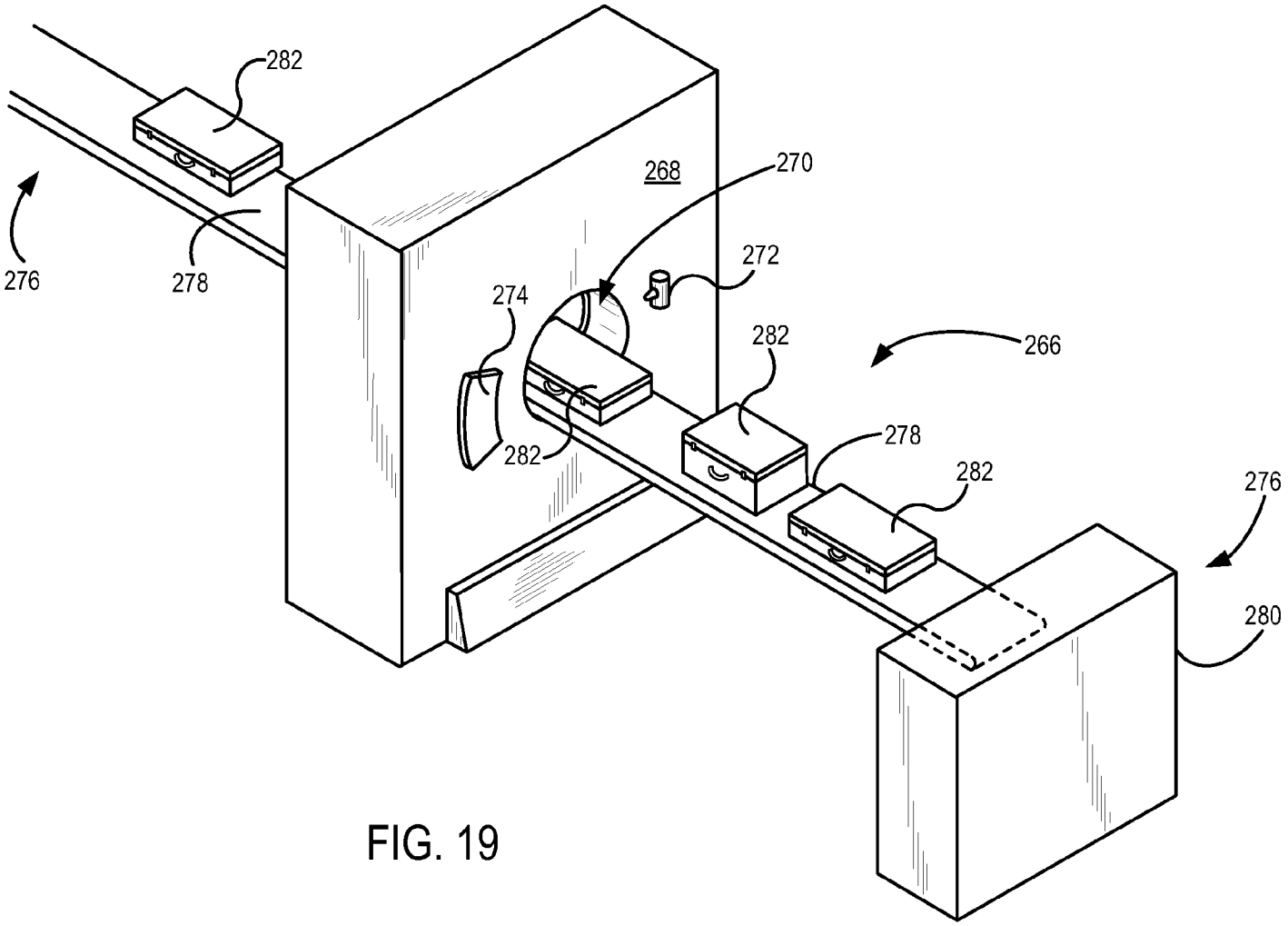
FIG. 19 is a pictorial view of an x-ray system for use with a non-invasive package inspection system according to an embodiment of the invention.

Referring now to FIG. 19, package/baggage inspection system 266 includes a rotatable gantry 268 having an opening 270 therein through which packages or pieces of baggage may pass. The rotatable gantry 268 houses a high frequency electromagnetic energy source 272 as well as a detector assembly 274 having detectors similar to those shown in FIG. 2. A conveyor system 276 is also provided and includes a conveyor belt 278 supported by structure 280 to automatically and continuously pass packages or baggage pieces 282 through opening 270 to be scanned. Objects 282 are fed through opening 270 by conveyor belt 278, imaging data is then acquired, and the conveyor belt 278 removes the packages 282 from opening 270 in a controlled and continuous manner. As a result, postal inspectors, baggage handlers, and other security personnel may non-invasively inspect the contents of packages 282 for explosives, knives, guns, contraband, etc.

A technical contribution for the disclosed method and apparatus is that it provides for a computer implemented apparatus and method for magnetically controlling an e-beam.

Therefore, in accordance with one embodiment, a control circuit for an electron beam manipulation coil for an x-ray generation system includes a first low voltage source and a second low voltage source. The control circuit also includes a first switching device coupled in series with the first low voltage source and configured to create a first current path with the first low voltage source when in a closed position and a second switching device coupled in series with the second low voltage source and configured to create a second current path with the second low voltage source when in a closed position. The control circuit further includes a capacitor coupled in parallel with an electron beam manipulation coil and positioned along the first and second current paths and a current source circuit electrically coupled to the electron beam manipulation coil and constructed to generate an offset current in the first and second current paths.

In accordance with another embodiment, a method for driving an electron beam manipulation coil includes the steps of (A) closing a first switching device to cause a first current at a first polarity to flow along a first current path, through a resonance circuit, and through a first energy storage device, the resonance circuit comprising an electron beam manipulation coil and a resonance capacitor; and (B) opening the first switching device after closing the first switching device to initiate a first resonance cycle in the resonance circuit. The method also includes the steps of (C) closing a second switching device after the first resonance cycle has been initiated to cause a second current at a second polarity to flow along a second current path, through the resonance circuit, and through a second energy storage device; and (D) controlling switching of a current source circuit to cause a shift in the first current and a shift in the second current such that an average of the shifted first current and the shifted second current is non-zero.

In accordance with yet another embodiment, a CT system includes a gantry having an opening therein for receiving an object to be scanned, a table positioned within the opening of the rotatable gantry and moveable through the opening, and an x-ray tube coupled to the rotatable gantry and configured to emit a stream of electrons toward a target, the target positioned to direct a beam of x-rays toward a detector. The CT system also includes a deflection coil mounted on the x-ray tube and positioned to deflect the stream of electrons. A control circuit is electrically coupled to the deflection coil. The control circuit includes a first low voltage source sized to supply steady-state current at a first polarity and a second low voltage source sized to supply steady-state current at a second polarity, opposite the first polarity. The control circuit also includes a first switch coupled to the first low voltage source and configured to create a first current path with the first low voltage source when the first switch is closed, and a second switch coupled to the second low voltage source and configured to create a second current path with the second low voltage source when the second switch is closed. A resonance capacitor is coupled in parallel with the deflection coil and positioned along the first and second current paths. A current shifting circuit electrically is coupled to the deflection coil and configured to inject a current offset in the first and second current paths. A controller is electrically coupled to the control circuit and programmed to control switching of the first and second switches.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A control circuit for an electron beam manipulation coil for an x-ray generation system comprising:

a first low voltage source;

a second low voltage source;

a first switching device coupled in series with the first low voltage source and configured to create a first current path with the first low voltage source when in a closed position;

a second switching device coupled in series with the second low voltage source and configured to create a second current path with the second low voltage source when in a closed position;

a capacitor coupled in parallel with an electron beam manipulation coil and positioned along the first and second current paths; and a current source circuit electrically coupled to the electron beam manipulation coil and constructed to generate an offset current in the first and second current paths.

2. The control circuit of claim 1 wherein the current source circuit comprises a bidirectional circuit configurable to inject one of a positive current offset and a negative current offset in the first and second current paths.

3. The control circuit of claim 1 wherein the current source circuit comprises a unidirectional circuit configured to inject one of a positive current offset and a negative current offset in the first and second current paths.

4. The control circuit of claim 3 wherein the current source circuit comprises:

a first offset switch;

an inductor coupled in series with the first offset switch;

a current monitoring device electrically coupled to the inductor; and a control electrically coupled to the current monitoring device, the control configured to monitor a current flow in the current source circuit and transmit switching signals to the first offset switch based on the monitored current.

5. The control circuit of claim 4 wherein the control is configured to close the first offset switch when the monitored current flow is less than a threshold.

6. The control circuit of claim 4 wherein the control is configured to open the first offset switch after a predetermined time period.

7. The control circuit of claim 4 wherein the control is configured to open the first offset switch when the monitored current flow is greater than a threshold.

8. The control circuit of claim 4 wherein the current source circuit further comprises an independent power supply configured to charge the inductor.

9. The control circuit of claim 4 wherein the current source circuit further comprises a second offset switch; and wherein the control is configured to:

transmit switching signals to the first offset switch to inject the positive current offset; and transmit switching signals to the second offset switch to inject the negative current offset.

10. The control circuit of claim 1 wherein the first and second low voltage sources are constructed to supply a voltage of approximately R*I volts, where R represents an overall parasitic resistance of the control circuit, and I represents a desired steady state current supplied to the electron beam manipulation coil.

11. The control circuit of claim 1 wherein the first low voltage source, the capacitor, and the first switching device are arranged to generate a current flow having a first polarity across the electron beam manipulation coil; and wherein the second low voltage source, the capacitor, and the second switching device are arranged to generate a current flow having a second polarity, opposite the first polarity, across the electron beam manipulation coil.

12. A method for driving an electron beam manipulation coil comprising the steps of:

(A) closing a first switching device to cause a first current at a first polarity to flow along a first current path, through a resonance circuit, and through a first energy storage device, the resonance circuit comprising an electron beam manipulation coil and a resonance capacitor;

(B) opening the first switching device after closing the first switching device to initiate a first resonance cycle in the resonance circuit;

(C) closing a second switching device after the first resonance cycle has been initiated to cause a second current at a second polarity to flow along a second current path, through the resonance circuit, and through a second energy storage device; and (D) controlling switching of a current source circuit to cause a shift in the first current and a shift in the second current such that an average of the shifted first current and the shifted second current is non-zero.

13. The method of claim 12 further comprising the steps of:

(E) opening the second switching device after closing the second switching device to initiate a second resonance cycle in the resonance circuit;

(F) closing the first switching device after the second resonance cycle has been initiated to cause the first current at the first polarity to flow along the first current path, through the resonance circuit, and through the first energy storage device; and (G) repeating steps (B)-(F).

14. The method of claim 12 further comprising controlling switching of the current source to maintain a steady-state shift in the first and second current.

15. The method of claim 14 further comprising:

monitoring a current flow in the current source circuit; and closing a switch in the current source circuit to recharge the current source circuit when the monitored current flow is below a threshold.

16. A computed tomography (CT) system comprising:

a rotatable gantry having an opening therein for receiving an object to be scanned;

a table positioned within the opening of the rotatable gantry and moveable through the opening;

a detector;

an x-ray tube coupled to the rotatable gantry and configured to emit a stream of electrons toward a target, the target positioned to direct a beam of x-rays toward the detector;

a deflection coil mounted on the x-ray tube and positioned to deflect the stream of electrons;

a control circuit electrically coupled to the deflection coil, the control circuit comprising:

a first low voltage source sized to supply steady-state current at a first polarity;

a second low voltage source sized to supply steady-state current at a second polarity, opposite the first polarity;

a first switch coupled to the first low voltage source and configured to create a first current path with the first low voltage source when the first switch is closed;

a second switch coupled to the second low voltage source and configured to create a second current path with the second low voltage source when the second switch is closed;

a resonance capacitor coupled in parallel with the deflection coil and positioned along the first and second current paths; and a current shifting circuit electrically coupled to the deflection coil and configured to inject a current offset in the first and second current paths; and a controller electrically coupled to the control circuit and programmed to control switching of the first and second switches.

17. The CT system of claim 16 wherein the current shifting circuit comprises:

a first offset switch;

a first inductor coupled in series with the first offset switch;

a first current probe electrically coupled to the first inductor;

a control electrically coupled to the first current probe to sense a current flow in the current shifting circuit; and wherein the control is configured to transmit switching signals to the first offset switch based on the sensed current flow.

18. The CT system of claim 17 wherein the current shifting circuit further comprises:

a second offset switch electrically coupled to the first current probe and the control; and wherein the control is configured to transmit switching signals to the second offset switch based on sensed current flow through the current shifting circuit.

19. The CT system of claim 16 wherein the current shifting circuit injects the current offset such that an average of the steady-state current supplied by the first low voltage source and the steady-state current supplied by the second low voltage source is non-zero.

20. The CT system of claim 16 wherein the current shifting circuit injects the current offset such that a minimum current flow through the deflection coil has a same polarity as a maximum current flow through the deflection coil.

21. The CT system of claim 16 wherein the controller is further programmed to:

receive a switching command corresponding to a user input; and selectively open and close the first and second switches of the control circuit based on the switching command to generate an alternating current through the deflection coil.

22. The CT system of claim 21 wherein the target has a first focal spot and a second focal spot positioned thereon; and wherein the deflection coil is positioned with respect to the x-ray tube such that the alternating current causes the stream of electrons to be deflected between the first focal spot and the second focal spot based on the switching of the first and second switches.

* * * * *